US007316142B2

(12) United States Patent
Lancaster

(10) Patent No.: US 7,316,142 B2
(45) Date of Patent: Jan. 8, 2008

(54) METAL SPIN FORMING HEAD

(76) Inventor: Paul B. Lancaster, 1432 Roberson Springs Rd., Loudon, TN (US) 37774

( * ) Notice: Subject to any disclaimer, the term of this patent is extended or adjusted under 35 U.S.C. 154(b) by 232 days.

(21) Appl. No.: 10/850,120

(22) Filed: May 21, 2004

(65) Prior Publication Data

US 2005/0257588 A1 Nov. 24, 2005

(51) Int. Cl.
*B21D 22/14* (2006.01)

(52) U.S. Cl. ..... 72/82; 72/84; 72/121; 72/110

(58) Field of Classification Search ..... 72/82, 72/83, 84, 85, 96, 120, 121, 381, 394, 398, 72/403, 399, 402, 107, 110; 29/890
See application file for complete search history.

(56) References Cited

U.S. PATENT DOCUMENTS

| | | | | |
|---|---|---|---|---|
| 3,793,863 | A | 2/1974 | Groppini | |
| 4,036,044 | A | 7/1977 | Yoshimura | |
| 4,951,490 | A * | 8/1990 | Gronert et al. | 72/10.4 |
| 4,953,376 | A | 9/1990 | Merlone | |
| 5,598,729 | A | 2/1997 | Hoffmann et al. | |
| 5,676,007 | A * | 10/1997 | Kostermeier | 72/96 |
| 5,906,127 | A * | 5/1999 | Nakamura | 72/85 |
| 5,937,516 | A | 8/1999 | De Sousa et al. | |
| 5,953,817 | A | 9/1999 | Watanabe et al. | |
| 5,979,203 | A | 11/1999 | Radocaj | |
| 6,026,666 | A * | 2/2000 | Zimmermann et al. | 72/85 |
| 6,162,403 | A | 12/2000 | Foster et al. | |
| 6,212,926 | B1 | 4/2001 | Jenness | |
| 6,233,991 | B1 | 5/2001 | Thimmel et al. | |
| 6,295,854 | B1 * | 10/2001 | Stein et al. | 72/96 |
| 6,381,843 | B1 | 5/2002 | Irie et al. | |
| 6,442,988 | B1 | 9/2002 | Hamstra et al. | |
| 6,477,879 | B1 * | 11/2002 | Sawa | 72/220 |
| 6,591,498 | B2 | 7/2003 | Irie et al. | |
| 6,701,617 | B2 | 3/2004 | Li et al. | |
| 2002/0062562 | A1 | 5/2002 | Li et al. | |
| 2002/0095787 | A1 | 7/2002 | Irie et al. | |
| 2003/0068256 | A1 | 4/2003 | Morikawa et al. | |
| 2004/0025341 | A1 | 2/2004 | Li et al. | |

FOREIGN PATENT DOCUMENTS

| | | |
|---|---|---|
| EP | 10057 | 4/1980 |
| EP | 81700 | 6/1983 |

(Continued)

*Primary Examiner*—Ed Tolan
(74) *Attorney, Agent, or Firm*—Richard C. Litman

(57) ABSTRACT

The present metal spin forming head includes two sets of rollers, with each set having a series of individual metal working rollers therein. The rollers of each set are circumferentially spaced evenly about the head, with each of the rollers of the second set being evenly positioned between corresponding rollers of the first set. The second roller set may be in a non-coplanar relationship with the first roller set. The first roller set comprises rollers having relatively broad widths, for forming the general contours of the workpiece. The second roller set comprises rollers having relatively narrow rims for forming circumferential grooves in the workpiece, resulting in corresponding beads within the workpiece for securing an article therein. The rollers are controlled independently of one another by a programmable logic control capable of driving the rollers cyclically as the workpiece (or spin forming head) rotates to form non-cylindrical shapes.

9 Claims, 4 Drawing Sheets

FOREIGN PATENT DOCUMENTS

| | | |
|---|---|---|
| EP | 1074704 | 2/2001 |
| EP | 1302253 | 4/2003 |
| GB | 2370007 | 6/2002 |
| JP | 2001-289041 | 10/2001 |
| JP | 2002-295249 | 10/2002 |

* cited by examiner

METAL SPIN FORMING HEAD

BACKGROUND OF THE INVENTION

1. Field of the Invention

The present invention relates generally to machinery and methods for spin forming metal tubes, pipes, circular sheet stock, and the like to form different diameters and shapes thereon. More specifically, the present invention comprises a multiple roller spin forming head in which a series of primary forming rollers are followed by a series of secondary or finishing rollers. The secondary rollers generally have a narrower width, thereby permitting the formation of relatively abrupt changes in diameter or shape for the workpiece. The present system utilizes a programmable logic circuit to control the individual rollers, with the system also providing for selective cyclic control of the rollers relative to workpiece rotation to allow non-circular cross sections to be shaped.

2. Description of the Related Art

The basic principle of spin forming has been known for several decades. This metal forming principle utilizes a roller which bears against a spinning, relatively thin walled sheet of metal (tube, pipe, or flat plate, depending upon the finished shape and configuration desired), with the distance or radius of the roller circumference from the spin axis of the workpiece, and the axial location of the roller relative to the workpiece, defining the final shape of the workpiece. This technique has been used to form aircraft and spacecraft components (propeller spinners, nose cones, etc.), and is highly desirable for forming various seamless shapes having circular cross sections.

The use of a single roller, and the circular cross-sectional shapes formed by conventional spin forming processes, greatly limits the use of such a forming technique in many other fields. The single roller spin forming system requires a relatively large amount of time per unit, and is generally limited to forming circular cross sectional shapes. Moreover, the process is even slower when harder and more difficult to work metals are used for the workpiece.

Most mufflers and catalytic converters have non-circular shapes, in order to provide relatively shallow heights to fit beneath the vehicle while still providing good ground clearance. As a result, most automotive exhaust systems have been formed using other manufacturing principles, e.g. stamped, multiple piece shells or housings for mufflers and catalytic converters. The exhaust silencing element or catalytic converter element is placed within one of the shells, with the opposite shell being placed thereover and welded to the first shell along a continuous seam. Other techniques have been used, such as the so-called "tourniquet wrap," but each of these techniques requires that the seams along the edges of the metal shell component(s) be welded, which requires an additional step and additional time in manufacture.

It can be difficult to produce an essentially perfectly sealed weld seam, and such near perfection is essential in modern automobiles. Slight exhaust leaks can result in anomalous readings in the on-board diagnostic systems with which all automobiles are presently equipped, as well as the possibility of exhaust leaks into the passenger compartment of the vehicle. These hazards increase over time, as welds are generally prone to attack by road salts and other environmental hazards during the life of the vehicle. The elevated temperatures at which such systems operate, particularly catalytic converters with the oxidizing and reducing reactions occurring therein, only serve to accelerate the deterioration of the system, particularly along the welds. It can be extremely difficult for an automotive exhaust manufacturer to produce a leakproof exhaust component which will remain roadworthy for the federally required 50,000 mile minimum life span for emissions control components, and this minimum distance is doubled 1o 100,000 miles in some areas.

The present invention provides a solution to the above problem by means of a multiple roller metal spin forming apparatus and method. The present spin forming system provides a series of primary rollers which are preferably evenly spaced about the circumference of the workpiece, and which perform the primary shaping of a seamless tube or other seamless workpiece. A secondary roller is placed between each of the primary rollers, with the secondary rollers having a smaller width and/or sharper edge radius in order to form relatively abrupt diametric transitions along the length of the workpiece. The present metal spin forming head is controlled by a programmable logic controller, which is programmed with the desired final shape of the workpiece. The exhaust control element (muffler, catalytic converter element, etc.) is placed within the unfinished seamless metal tube, the tube is installed in the fixture, and the present multiple roller spin forming apparatus is applied to the workpiece to "neck down" the diameter of the tube at each end of the element installed therein, thereby securing the element immovably within the tube. The use of multiple rollers enables faster completion of the finished product for greater manufacturing efficiency, with the more rapid forming of the metal resulting in greater heating of the workpiece during manufacture, thereby annealing the workpiece for greater ductility to provide easier working during the forming process.

The present invention also enables components with non-circular cross sections to be formed. Each of the rollers of the multiple roller head may be controlled independently of one another, and may be driven radially inwardly or outwardly in a cyclic pattern, i.e. at certain points or areas about the circumference of the workpiece. By repeatedly driving the rollers inwardly only at a certain area(s) about the workpiece circumference, a non-circular cross sectional shape may be formed as desired. The final result is a weldless, seamless housing or shell having any desired external contour as required according to the internal componentry installed therein and the external space and installation limitations for the device.

A discussion of the related art of which the present inventor is aware, and its differences and distinctions from the present invention, is provided below.

U.S. Pat. No. 3,793,863 issued on Feb. 26, 1974 to Diego Groppini, titled "Device For The Manufacture Of Metal Cylinders," describes a metal spin forming apparatus in which a workpiece is rotated while a pair of relatively stationary rollers shape the workpiece. The rollers have concave faces and are disposed at one end of the workpiece with their axes angularly offset from one another, rather than comprising two groups of rollers with each group lying in the same plane with all rollers having their axes parallel to one another, as in the present invention. The Groppini apparatus can only shape the end of a metal workpiece to form a closed end, as in forming a gas cylinder or the like. Groppini recognizes the desirability of keeping the metal workpiece hot for ductility and ease of working the material, but he does not disclose multiple roller sets each operating in their own plane, nor does he disclose any form of computerized control system for adjusting the radii of the various rollers either independently or in concert with one another, as provided by the present invention.

U.S. Pat. No. 4,036,044 issued on Jul. 19, 1977 to Tomio Yoshimura, titled "Process For Forming Metal Pipes To A Desired Shape," describes a three roller spin forming head and process for forming aluminum baseball bats. Yoshimura provides a template or model and mechanically controls the radial and axial positions of his rollers to form the final shape of the bat in accordance with the template or guide used. The present spin forming system also provides for rotation of the workpiece and axial motion of the rollers along the workpiece during the shaping process. However, the present system utilizes two closely related rows of rollers, i.e. primary and secondary rollers, which provide different shaping of the workpiece at different points in the shaping process. Moreover, the present system is controlled by a programmable logic control, which provides for cyclic positioning of the rollers in order to form workpieces having non-circular cross sections, if so desired.

U.S. Pat. No. 4,953,376 issued on Sep. 4, 1990 to John C. Merlone, titled "Metal Spinning Process And Apparatus And Product Made Thereby," describes a spin forming process in which a pneumatic or hydraulic bladder is inserted into the workpiece and inflated to prevent the workpiece from being crushed during extreme spin forming operations. The disclosure provides for an optional second roller for the spin forming apparatus, with the second roller being diametrically opposite the first. However, no secondary rollers having different roller wheel shapes and operating selectively independently of the primary roller, is disclosed, nor is any form of programmable logic control for selectively controlling the various rollers independently of one another and/or cyclically in order to produce a finished product having a non-circular cross section, as provided by the present invention.

U.S. Pat. No. 5,598,729 issued on Feb. 4, 1997 to Benjamin R. Hoffmann et al., titled "System And Method For Constructing Wall Of A Tube," describes a system in which inductive electric heaters are applied to the workpiece to soften the metal for easier working. A pair of axially offset rollers are disclosed, for forming the cylindrical and end portions of the workpiece. A computer control system is described, but no selectively independent control of separate primary and secondary rollers is disclosed, nor is any means of cyclic control of the rollers provided for forming workpieces with non-cylindrical cross sections.

U.S. Pat. No. 5,937,516 issued on Aug. 17, 1999 to Egas J. De Sousa et al., titled "Method For Spin Forming Articles," describes a spin forming head having a series of axially parallel, cylindrical rollers each having a conical tip and each being a different radial distance from the center of the head. Each roller extends from the base plate of the head to a different height. The head and rollers are applied to the open end of a tube, with the conical tip of each roller contacting the end of the tube at a different point along the tube as the tube and head are moved axially toward one another. The conical tips of the outermost roller first contacts the edge of the tube, with progressively inwardly positioned rollers subsequently contacting the tube to progressively form a conical end for the tube. The De Sousa et al. roller head can only form a single conically shaped end on a tube; it cannot be adapted to form other shapes or to neck down a tube at some intermediate point(s) along its length. Moreover, De Sousa et al. do not disclose any form of cyclic operation for their spin forming head.

U.S. Pat. No. 5,953,817 issued on Sep. 21, 1999 to Motoki Watanabe et al., titled "Process For Producing Monolithic Catalyst Converter," describes the installation of a catalytic converter element into a seamless tube by first forming one end of the tube, then drawing or spin forming the opposite end of the tube after the catalytic element has been placed in the tube. This is essentially the goal of the present invention, but Watanabe et al. do not disclose any significant details of the apparatus used to spin form the end of the tube. The Watanabe et al. device does not have a series of primary and a series of secondary rollers providing for general and narrow shaping of various areas of the tube, as does the present invention. Moreover, Watanabe et al. do not disclose any means of selectively and independently controlling each of the rollers to form various shapes having circular and non-circular cross sections, as does the present invention.

U.S. Pat. No. 5,979,203 issued on Nov. 9, 1999 to Mijo Radocaj, titled "Apparatus For Spin-Forming A Circular Body From A Flat Blank Metal Workpiece," describes an apparatus for splitting a circular disc about its circumference and spreading the split to form a pulley groove therearound. The apparatus and method cannot be used to neck down the diameter of a tube at different points therealong or to form a tubular component with a non-circular cross section, as can the present invention.

U.S. Pat. No. 6,162,403 issued on Dec. 19, 2000 to Michael R. Foster et al., titled "Spin Formed Vacuum Bottle Catalytic Converter," describes a catalytic converter having three concentric shells with inner and outer vacuum chambers disposed therein. The spin forming process is accomplished in accordance with U.S. patent application Ser. No. 08/766,269 (col. 2, lines 43-44). This is the serial no. for the '516 issued U.S. Patent to De Sousa et al., discussed further above. The same points of difference between the method of the De Sousa '516 U.S. Patent and the present invention noted in that discussion are seen to apply here as well.

U.S. Pat. No. 6,212,926 issued on Apr. 10, 2001 to Blair L. Jenness, titled "Method For Spin Forming A Tube," describes various embodiments for spin forming the end of a tube. In at least one embodiment, a controller and inductive heating element are provided, in addition to the roller apparatus. The controller controls the positioning of the heating element relative to the rollers, in order to soften the metal at the area where the spin forming is taking place. Jenness does not disclose any means of independently positioning the individual rollers to form products having non-circular cross sections, nor does he disclose a primary and a secondary set of rollers to provide precise changes in diameter of the workpiece, as provided by the present invention. The heating element of Jenness (and others) is not needed in the present invention, because the relatively high level of metal forming taking place with the multiple rollers of the present invention results in significant heating of the metal, which serves to anneal the metal to make it more malleable during the forming process.

U.S. Pat. No. 6,233,991 issued on May 22, 2001 to Frederick H. Thimmel et al., titled "Apparatus And Method For Spin Forming A Tube," describes a series of embodiments for spin forming solid rollers and tubes. A spin forming apparatus which does not require any form of mandrel or die to support the tube between its two ends is also disclosed. This system provides at least one end support which is axially movable along the length of the tube, to support the tube immediately adjacent the area where the rollers are performing their shaping of the tube. Multiple rollers are disclosed, but all of the rollers lie in the same rotational plane; none are offset from one another, as is the case with the primary and secondary sets of rollers of the present invention. Moreover, Thimmel et al. do not disclose any means of selectively and independently controlling their various rollers on a cyclic basis to form shapes having other than circular cross sections, as can the present invention.

U.S. Pat. No. 6,381,843 issued on May 7, 2002 to Tohru Irie et al., titled "Method Of Producing A Catalytic Converter," describes the insertion of a catalytic converter substrate and shock absorbent mat into a metal shell, and reducing the diameter of the shell by a spin forming process to secure the catalytic converter element and mat within the shell. The shell and its contents are held relatively stationary in the Irie et al. process, with the spin forming head rotating around the stationary workpiece. Irie et al. also describe a means of axially offsetting their rotating spin head apparatus relative to the axis of the workpiece, in order to form an angularly offset inlet or outlet for the completed assembly. The present invention may also provide for such axially offset portions of the finished product, but accomplishes such an operation in a completely different manner, i.e. by cyclically moving the various rollers radially inwardly and outwardly as the workpiece rotates relative to the rollers and spin forming head. It is also noted that Irie et al. do not disclose any form of programmable logic control for moving the individual rollers radially relative to one another and to the workpiece, nor do they disclose at least two separate sets of rollers which perform different operations on the workpiece, as is accomplished by the present invention.

U.S. Pat. No. 6,442,988 issued on Sep. 3, 2002 to Peter Hamstra et al., titled "Methods Of Spin Forming Initially Cylindrical Containers And The Like," describes various embodiments of spin forming techniques, most directed to the insertion of a mandrel within the workpiece in order to define the finished form of the workpiece after spin forming. One embodiment employs multiple rollers in two non-coplanar sets, but the disclosure states that all rollers are bearing against the workpiece simultaneously in order to preclude wrinkling of the thin sheet metal of the workpiece during severe forming operations. In contrast, the various rollers of the present spin forming invention may be separately and independently applied against the workpiece to produce different shapes and diameters as desired. Moreover, Hamstra et al. state that their spin forming system cannot be used to form non-circular cross sections (Summary of the Invention, col. 2, lines 8-11). In the present invention, the various rollers may be driven inwardly or outwardly independently of one another and cyclically, i.e. applying force only at a certain point(s) about the circumference of the workpiece during its rotation cycle as it is being formed. This is accomplished by means of a programmable logic control; Hamstra et al. do not disclose such a means of controlling the movement of the rollers in their spin forming head.

U.S. Pat. No. 6,591,498 issued on Jul. 15, 2003 to Tohru Irie et al., titled "Method Of Producing A Catalytic Converter," is a continuation in part of the '843 U.S. Patent to the same inventors, discussed further above. The same points of difference discussed further above between the apparatus and method of the '843 U.S. Patent and the present invention, are seen to apply here as well.

U.S. Pat. No. 6,701,617 issued on Mar. 9, 2004 to Houliang Li et al., titled "Spin-Forming Method For Making Catalytic Converter," describes a spin forming system in which a single spin forming roller is driven cyclically against the metal workpiece shell. The cyclic positioning of the roller is governed in accordance with a controller to accurately form the shell in accordance with any slight out-of-round shape of the catalytic converter element installed therein. Li et al. also state that their spin forming system and controller can form shells having considerably greater non-circular cross sectional shapes, as well. However, the Li et al. system is relatively slow, as it utilizes only a single roller. The present system utilizes at least two sets of multiple rollers, with the two sets comprising primary and secondary rollers. The primary rollers perform the basic shaping operation, while the secondary rollers with their relatively sharp edges are used to form the relatively sharp circumferential crimps which are used to lock a component (e.g. catalytic converter, exhaust muffler assembly, etc.) within the shell. The present invention utilizes a programmable logic control to move the various multiple rollers independently of one another as required, which operation is not disclosed in any of the related art of which the present inventor is aware.

U.S. Patent Publication No. 2002/62,562 published on May 30, 2002, titled "Method Of Spin Forming Oblique End Cones Of A Catalytic Converter," describes a spin forming system using only a single roller, with the radial and axial position of the roller being governed by computer aided engineering design tools. The system may provide cyclic positioning of the roller in order to form oblique or angularly offset end portions for the shell or workpiece. The '562 publication briefly mentions the possibility of multiple rollers in this disclosure, but does not show any relationship between such multiple rollers, nor does it describe any different functions or different operation of such multiple rollers. The present invention specifically provides for multiple sets of rollers, with each set containing a plurality of rollers and with the rollers of a second set alternatingly following the rollers of the first set and being at least slightly out of plane therewith. This enables the first set of rollers to rapidly form the basic shape of the workpiece, with the rollers of the second set being independently driven to form the finished shape, comprising relatively sharp depressions and creases for locking elements within the workpiece shell. The multiple rollers of the present spin forming invention may also be actuated cyclically to provide axially offset or obliquely angled portions of a spin formed shell, if so desired.

U.S. Patent Publication No. 2002/95,787 published on Jul. 25, 2002 to Tohru Irie et al., titled "Method Of Producing A Catalytic Converter," is a continuation in part. of the issued '843 U.S. Patent discussed further above. The same points noted in that discussion are seen to apply here as well.

U.S. Patent Publication No. 2003/68,526 published on Apr. 10, 2003 to Junji Morikawa et al., titled "Spin-Forming Method, Spin-Forming Apparatus, And Catalytic Converter," describes a rotating spin forming head having a single roller which bears against a workpiece which may be rotated relative to the stationary portion of the mechanism. The roller may be eccentrically oscillated to form axially offset or obliquely angled end portions on the workpiece, depending upon the relative position of the workpiece in the fixture. While two rollers are illustrated in some embodiments of the disclosure, they are diametrically opposed to one another. No multiple roller assemblies comprising plural sets of rollers for providing initial and finishing spin forming of the workpiece are disclosed.

U.S. Patent Publication No. 2004/25,341 published on Feb. 12, 2004, titled "Spin-Forming Method For Making Catalytic Converter," is the pre-issuance publication of the issued '617 U.S. Patent to the same inventors, discussed further above. The same points noted in the discussion of the issued '617 U.S. Patent are seen to apply here as well.

European Patent Publication No. 10,057 published on Apr. 16, 1980, titled "Method And Machine For Spin Forming Thin-Walled Seamless Tubular Elbows," describes (according to the drawings and English abstract) a machine for spin forming tubular elbows. A triple roller head is shown in the drawings, but no means is apparent for moving the rollers independently of one another or moving them axially along the length of the elbow.

European Patent Application No. 81,700 published on Jun. 22, 1983, titled "Spin Forming," describes a system for heating and cooling the metal workpiece during the spin forming operation in order to maintain the temper of the metal. The apparatus is directed to the forming of relatively thick walled articles, such as tanks for the storage of pressurized gas. Only a single relatively blunt wheel is disclosed. No multiple forming wheels or rollers in multiple planes are disclosed to provide the rapid and precise spin forming benefits of the present invention.

European Patent Application No. 1,074,704 published on Feb. 7, 2001, titled "Method Of Producing A Catalytic Converter," is based upon the same Japanese parent patent publication as the '843 U.S. Patent discussed further above. Accordingly, the points noted in the discussion of the '843 U.S. Patent are seen to apply here as well.

Japanese Patent Publication No. 2001-289,041 published on Oct. 19, 2001, titled "Exhaust Emission Controlling Catalytic Converter, Diesel Particulate Filter System, And Their Manufacturing Methods," describes (according to the drawings and English abstract) a method of manufacturing such an exhaust control device, including a very general description of spin forming the end(s) of the shell. No details are apparent regarding the number of forming rollers, their positional relationship, or their control system.

British Patent Application Publication No. 2,370,007 published on Jun. 19, 2002, titled "A Method Of Spin Forming Oblique End Cones Of A Catalytic Converter," is based upon the same U.S. provisional patent application from which the '562 U.S. Patent Application Publication, discussed further above, was published. The same points noted in the discussion of the '562 U.S. Patent Application Publication are seen to apply here as well.

Japanese Patent Publication No. 2002-295,249 published on Oct. 9, 2002, titled "Catalytic Converter," describes (according to the drawings and English abstract) the insertion of a catalytic converter element into a metal shell, and spin forming the ends of the shell. No other disclosure of the specifics of the spin forming operation are shown in the drawings or described in the English abstract.

Finally, European Patent Application Publication No. 1,302,253 published on Apr. 16, 2003, titled "Spin-Forming Method, Spin-Forming Apparatus, And Catalytic Converter," is based upon the same Japanese parent patent publication upon which the '256 U.S. Patent Application Publication, discussed further above, is based. The same points noted in the discussion of the '256 U.S. Patent Application Publication are seen to apply here, as well.

None of the above inventions and patents, taken either singly or in combination, is seen to describe the instant invention as claimed. Thus a metal spin forming head solving the aforementioned problems is desired.

SUMMARY OF THE INVENTION

The present metal spin forming head is configured to provide much more rapid and accurate spin forming of metal tubes and similar workpieces. While the present spin forming head may be adapted for use in spin forming a generally tubular shape of any practicable size and for any practicable purpose, it is particularly well suited for forming shells or housings for catalytic converters in automotive exhaust systems.

The present spin forming head includes a series of separate spin forming rollers or wheels comprising at least two sets. The first set comprises a series (preferably four, more or less) of relatively wide edged rollers evenly spaced about the inner circumference of the tool head and about the outer circumference of the workpiece. These first rollers accomplish most of the shaping of the workpiece, working it to the generally desired diameter at the generally desired locations along the length of the workpiece. The second roller set comprises a series of rollers each circumferentially spaced between two of the first series rollers. The second set rollers may be displaced from coplanar alignment with the first set rollers. The second or finishing series of rollers each have relatively narrower or sharper edges, and provide for the forming of relatively sharp creases or circumferential grooves in the workpiece. These circumferential indentations result in corresponding circumferential ridges within the workpiece, which serve to secure an article (e.g., catalytic converter element) immovably within the shell, without need for mechanical fastening means.

The various rollers may be actuated to extend and retract radially relative to the forming head and workpiece therein. A programmable logic control communicates with each of the rollers, and enables each of the rollers to be positioned independently of or in concert with any or all of the other rollers. Typically, when a catalytic converter shell is being formed, the primary rollers provide the general shaping of the shell, with the secondary rollers then forming the precise grooves, or indentations required. The primary rollers may then make one last pass over the surface of the shell to smooth any irregularities which may have been formed therein during the forming of the circumferential indentations.

The programmable logic control used to position the multiple rollers of the present spin forming head, is able to provide sufficiently rapid actuation of each of the rollers so as to actuate the rollers cyclically during the rotation of the workpiece within the head (or alternatively, the rotation of the head about the stationary workpiece). Thus, any of the rollers may be driven down (e.g., via conventional hydraulic or other actuating means) at one specific point or area about the circumference of the workpiece at each revolution of the workpiece (or head, if the head is being rotated), to form a shape having a non-cylindrical cross section. The present metal spin forming head with its programmable logic control is thus capable of forming virtually any practicable shape which may be formed from a cylindrical tube.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention comprises a head assembly for spin forming tubular metal components. The present metal spin forming head incorporates numerous features and advantages not provided in earlier developed devices of the related art. The present spin forming head is capable of forming relatively narrow circumferential grooves about the workpiece, which result in corresponding circumferential beads in the interior of the workpiece. These circumferential beads serve to secure an internal element, e.g. a catalytic converter element within a catalytic converter shell, within the tubular component. Moreover, the present spin forming device is capable of forming finished shapes having non-circular cross sections, due to the cyclic actuation of the rollers made possible by the programmable logic control which controls the system.

Figure 1:
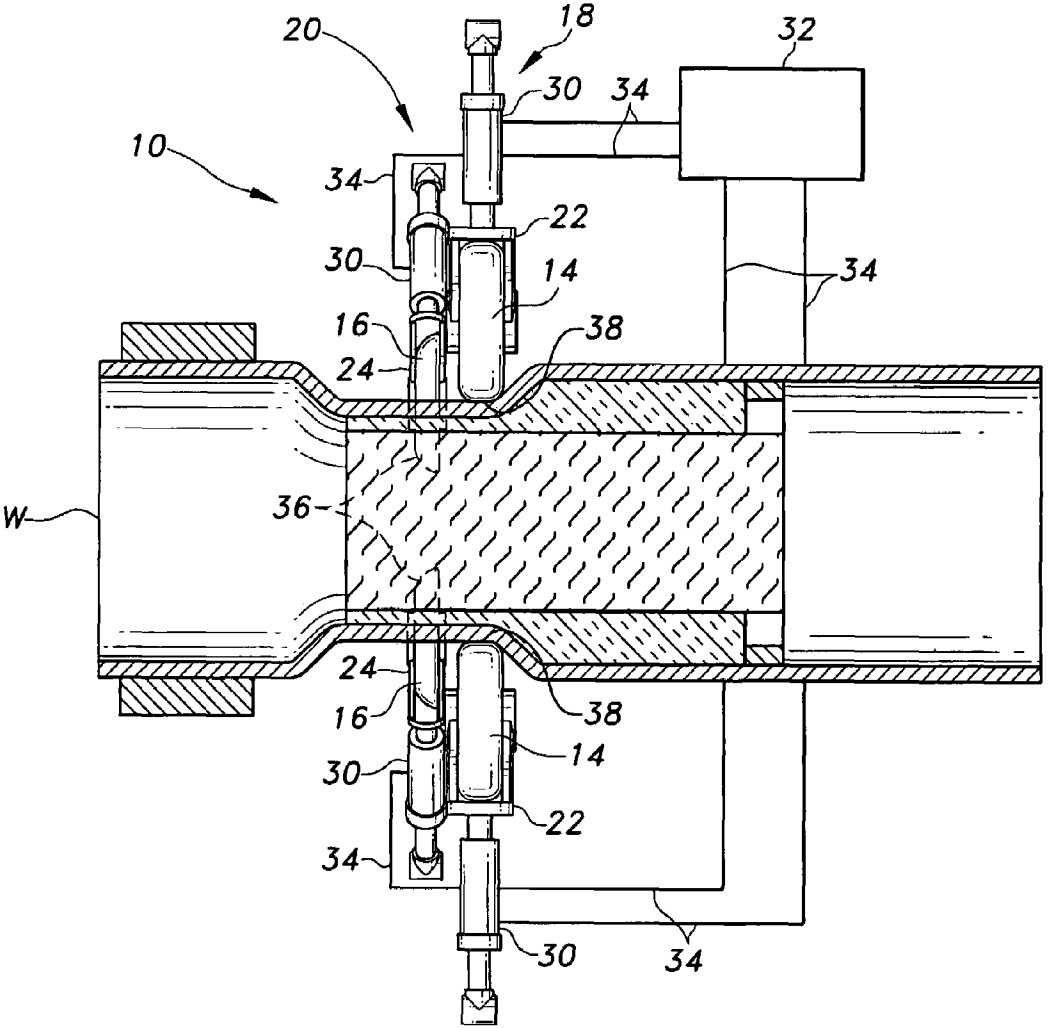
FIG. 1 is a side elevation view in section of a metal spin forming head according to the present invention, showing its operation in spin forming a tubular workpiece.

FIG. 1 of the drawings provides a schematic side elevation view in section of the present invention, shown positioned upon a tubular metal workpiece W. The present metal spin forming head 10 includes a roller fixture 12 (shown schematically by the circle in FIG. 2), with a series of first and second rollers, respectively 14 and 16, extending radially inwardly about the circumference of the fixture 12. The first rollers 14 form a first roller set 18 and the second rollers 16 form a second roller set 20. The rollers 14 and 16 are evenly spaced about the circumference of the roller fixture 12, as can be seen in FIG. 2, with the one of the second rollers 16 being positioned between each two of the first rollers 14.

With four rollers 14 forming the first roller set 18 and a like number of rollers 16 forming the second roller set 20, it will be seen that the rollers in each set 18 and 20 are circumferentially spaced about the roller fixture by 90 degrees, with each of the second rollers 16 spaced 45 degrees between each two of the first rollers 14. (The second rollers 16 are partially concealed behind the workpiece W in FIG. 1, due to their angular displacement around the workpiece W.) The rollers 14 and 16 of the first and second sets 18 and 20 may all lie in the same plane, as would appear in the end elevation view of FIG. 2, or the rollers 16 of the second set 20 may be offset from the plane of the rollers 14 of the first set 18, as shown in FIG. 1. The non-coplanar spacing shown in FIG. 1 between the two roller sets 18 and 20 may be exaggerated, to show more clearly the features of the two different roller types 14 and 16 in FIG. 1.

Figure 2:
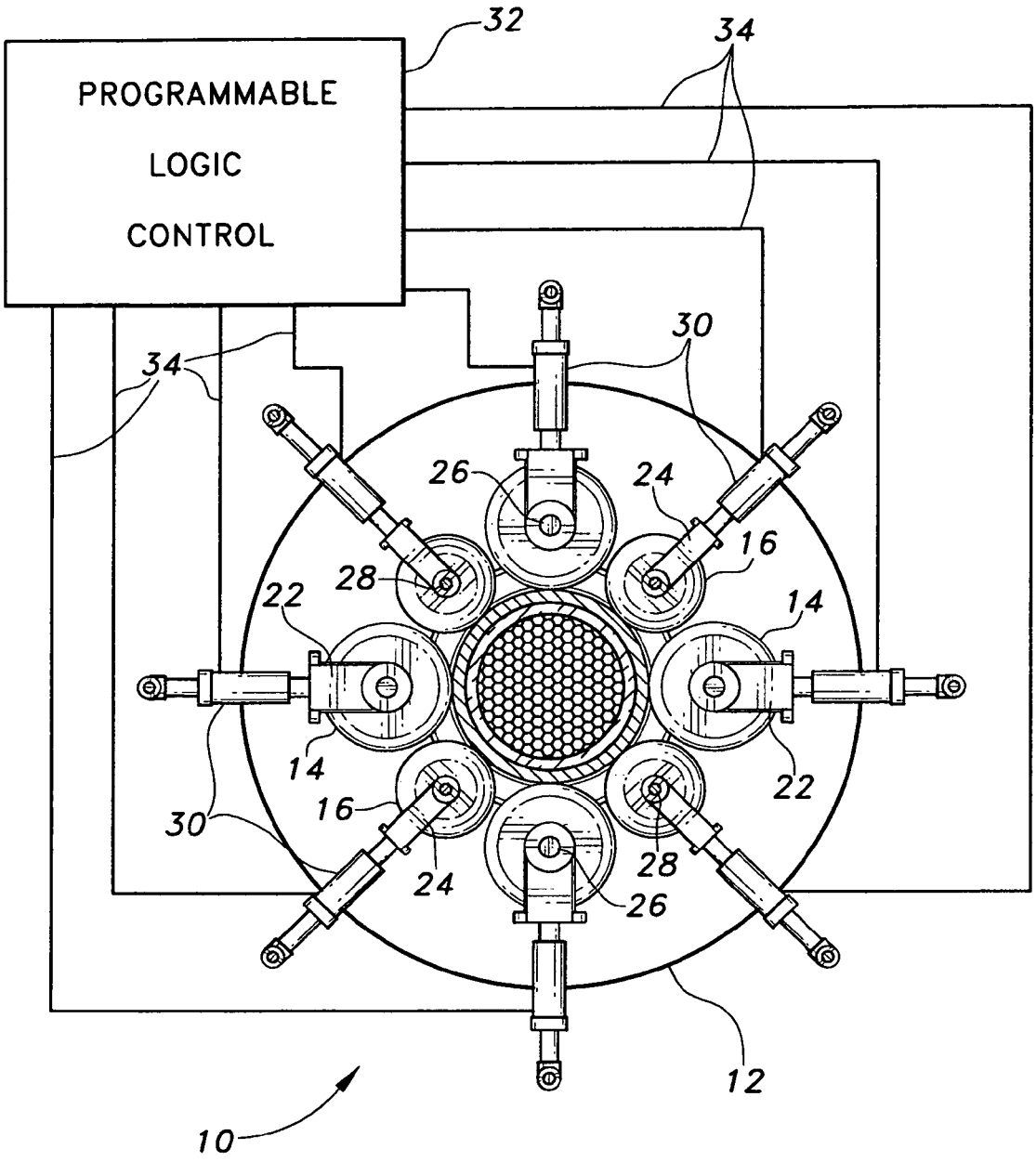
FIG. 2 is a schematic front elevation view of the roller configuration of the present spin forming head, showing the relative circumferential positioning of the rollers.

Each of the rollers 14 and 16 is pivotally secured on a bracket, respectively 22 and 24, by a pivot pin, respectively 26 and 28 (shown in FIG. 2). Each of the rollers 14 and 16 pivots freely upon its respective pin 26 or 28 to roll upon the surface of the workpiece W. Each of the roller brackets 22 and 24 is mounted on its own independent actuator, e.g. a hydraulic cylinder 30. (Other means of radially adjusting the positions of the rollers 14 and 16 may be provided as desired, but hydraulics provide the rapid actuation and precise positioning required of the present invention.) The hydraulic cylinders 30 are powered conventionally, i.e. by a hydraulic fluid supply and pump which supplies hydraulic pressure to each of the cylinders 30, as is known in the art of hydraulic control systems.

Each of the cylinders 30 is controlled by a programmable logic control 32, which communicates with each cylinder 30 by means of a separate line 34. The control 32 may be programmed as desired to actuate the hydraulic cylinders 30 in order to form the desired shape of the tubular workpiece W during the forming operation. The programmable logic control 32 is provided with the radial and axial position of the workpiece W relative to the spin forming head 10 and rollers 14 and 16, by conventional means. When the precise radial or rotational position and axial position of the workpiece W is known, the various rollers 14 and 16 may be actuated collectively or independently of one another by the control 32 and hydraulic cylinders 30, to actuate the rollers 14 and 16 radially inwardly or outwardly toward or away from the workpiece W as desired, to form the desired shape.

The above-described spin forming system 10 as shown in FIGS. 1 and 2, is capable of forming myriad different shapes from a tubular workpiece W. For example, it is often necessary to retain an internal component within an outer tubular shell. The present spin forming apparatus 10 enables this to be accomplished easily and quickly, by forming circumferential crimps or depressions externally in the shell, with those external crimps resulting in internally formed beads or protrusions within the shell to secure an article therein.

Figure 3:
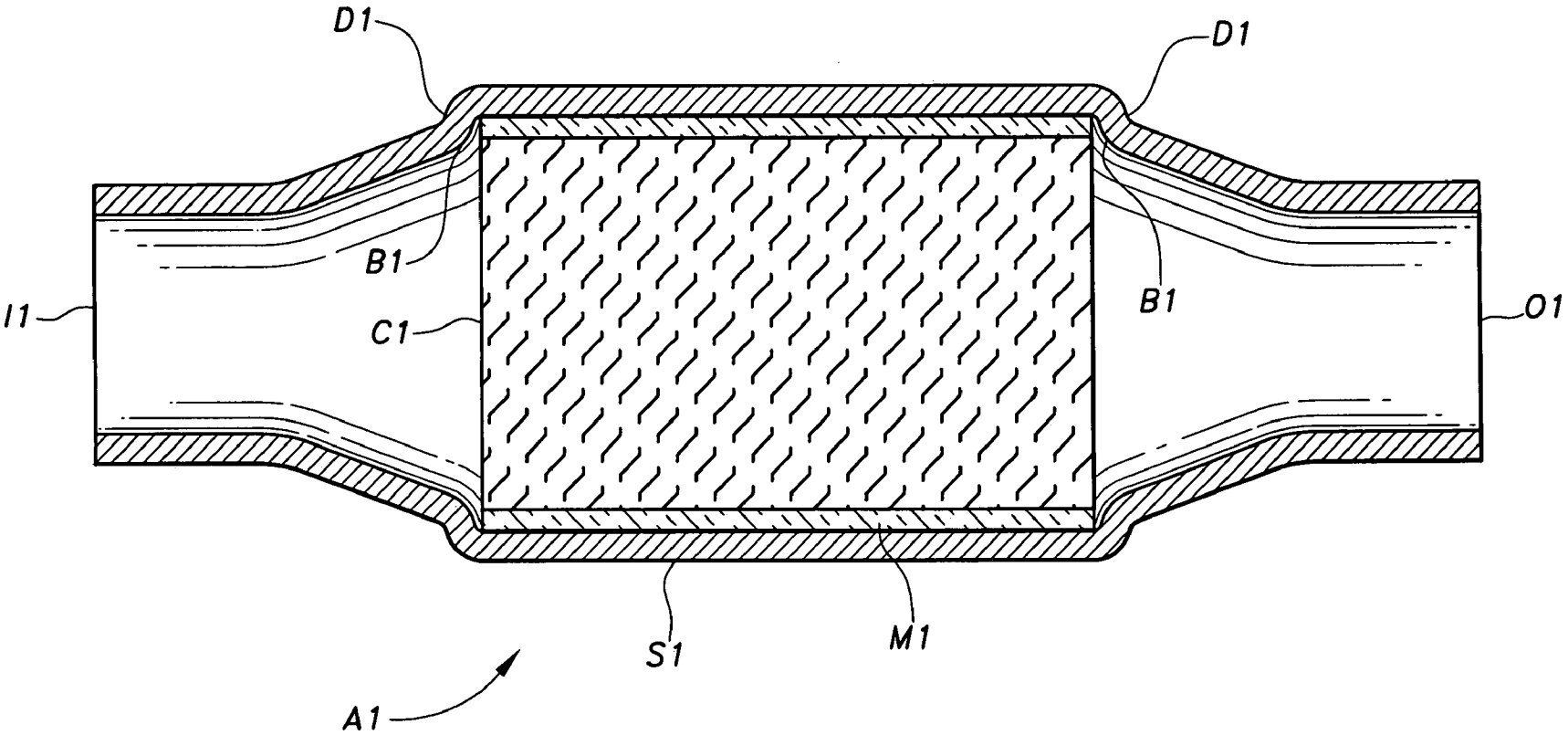
FIG. 3 is a side elevation view in section of a completed catalytic converter, showing the circumferential crimps or indentations which may be formed by means of the present spin forming head for securing an element within the outer shell.

FIG. 3 illustrates an exemplary completed assembly, comprising a catalytic converter assembly A1 having a tubular shell S1 with a catalytic converter element C1 captured therein. A ceramic mat M1 or the like is wrapped around the catalytic element C1 and the assembly is inserted into the shell S1 before forming the shell, as is known in the art. The present invention is used to "neck down" the outer diameter of the tubular shell S1 by means of the spinning process, compressing the ceramic mat M1 tightly against the catalytic converter element C1 to grip the element C1 within the shell S1. The ends of the shell S1 are further reduced in diameter to an inlet end I1 and outlet end O1 compatible with the conventional pipe sizes used in automotive exhaust systems. This is accomplished using conventional spin forming techniques, using the present invention.

The catalytic element C1 is further secured within the shell S1 by a sharp reduction in diameter at each end of the element C1, formed by a circumferential crimp or depression D1 in the outer portion of the shell S1. This results in a corresponding internal bead B1 at each end of the catalytic element C1. This is accomplished by means of the secondary rollers 16, with their relatively narrow rims or edges 36 in comparison to the relatively wide rims or edges 38 of the first rollers 14; this is shown clearly in the side elevation view of FIG. 1. The programmable logic control 32 selectively actuates the various rollers of the first and second sets 18 and 20 to form relatively broad or narrow, sharp reductions in diameter of the tubular shell S1.

In the example resulting in the catalytic converter assembly A1 shown in FIG. 3, the tubular shell S1 with the catalytic converter unit C1 and its surrounding mat M1 installed therein, are placed within a rotary fixture and the spin forming head 10 is positioned about the shell S1, generally as shown in FIGS. 1 and 2. (Alternatively, the assembly A1 may be placed in a stationary fixture and the spin forming head 10 rotated about the workpiece, with suitable hydraulic and electrical connections being provided to allow the operation of the rotating head assembly 10.)

The programmable logic control 32 is programmed with the exact position of the catalytic converter assembly A1, along with the desired finished shape of the assembly. The assembly A1 is then spun in its fixture (or the head assembly 10 is spun about the stationary assembly A1), with the first rollers 14 with their relatively wide rims or edges 38 being selectively urged against the outer surface of the shell S1 in accordance with the programming. The secondary rollers 16 are clear of the surface of the shell at this point in the process. The shell S1 is advanced axially through the planes of the two roller sets 18 and 20, with the programming urging the first rollers 14 against the surface of the shell S1 to neck down the diameter of the shell, as is known in the art of spin forming.

When the shell S1 has been formed to have the general shape and contour desired (this may require several passes, depending upon the material and thickness of the shell S1), the shell S1 is positioned axially with respect to the secondary rollers 16 so as to place the secondary rollers 16 with their narrow rims 36 at one end of the catalytic converter element C1. The first rollers 14 are removed from contact with the shell S1 (or make only light, non-deforming contact with the shell S1) and the second rollers are urged into the metal of the shell S1 at one end of the catalytic converter element C1. This produces a first relatively sharp circumferential depression D1 at the circumferential line of contact, with the shell S1 being shifted axially relative to the tool 10 to form another like depression D1 at the opposite end of the catalytic converter element C1 to lock the catalytic converter element C1 in place within the shell S1.

Figure 5:
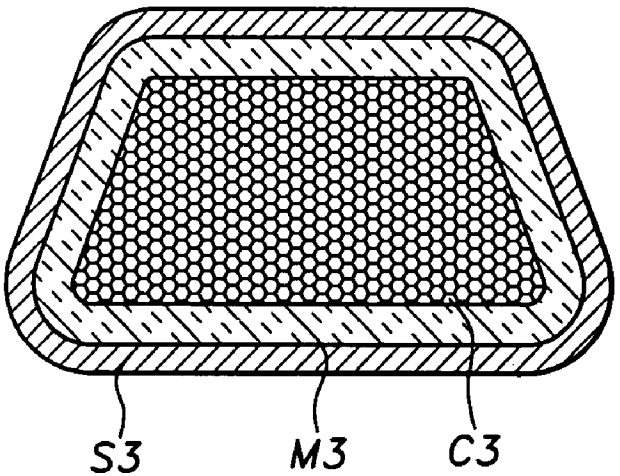
FIG. 5 is an end elevation view in section of an exemplary, generally trapezoidal shape which may be formed using the present multiple roller spin forming head and its programmable logic control.
Figure 4:
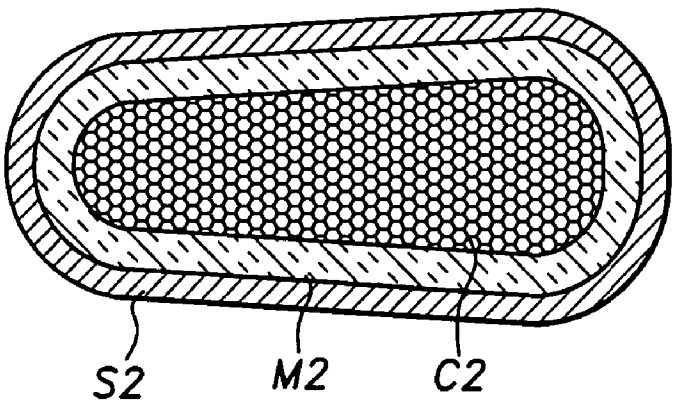
FIG. 4 is an end elevation view in section of an exemplary, tapered oval shape which may be formed using the present multiple roller spin forming head and its programmable logic control.

The present spin forming head 10 is also capable of forming articles having non-circular cross sections, due to the rapid and precise independent actuation of the various rollers 14 and 16 by means of the programmable logic controller 32. FIGS. 4 and 5 provide end elevation views in section of catalytic converters having such non-circular cross sections. In FIG. 4, a catalytic converter element C2 having a tapered oval shape is wrapped with a mat M2 and initially placed within a shell having a circular cross section. The controller 32 is programmed with the desired finished geometrical shape of the assembly, and the various rollers 14 and 16 are urged against the metal shell in a cyclic pattern, i.e. each individual roller is urged into the portion of the shell to be flattened as the assembly is rotated within the spin forming head 10 (or as the head 10 is rotated around the assembly), independently of other rollers. As each individual roller approaches the major diameter of the assembly, pressure is eased to allow the roller to roll around the end of the oval shape without producing any deformation. Pressure is increased as the roller passes over the opposite flattened side, with the trailing roller having pressure reduced as it passes around the elongate end of the cross section. The process is continued until the final shape is completed. FIG. 5 provides another end elevation view in section, comprising a generally trapezoidal shape defined by a trapezoidal catalytic converter element C3 within a ceramic mat M3, with the shell S3 having been formed generally as described above to form a closely fitting trapezoidal cross sectional shape.

In conclusion, the present metal spin forming head greatly expands the variety of different shapes which may be formed using the spin forming process. Spin forming is a highly desirable method of shaping metal shells which are required to have relatively high strength and/or corrosion resistance, as such spin formed shells do not have welded seams which are prone to attack by corrosives. Spin forming is a particularly desirable process for forming catalytic converter shells for use with automotive exhaust systems. The present spin forming head, with its number of independently positionable rollers, enables such shells to be formed to fit converter elements having flattened or other non-circular cross sectional shapes; this was difficult or impossible to achieve in the past in seamless structures, at least using any form of relatively rapid and economical forming technique.

The present invention provides further advantages by means of the relatively large number of rollers simultaneously applying force to the metal. The deformation of the metal by each roller produces some internal heating of the workpiece as the metal is forced to flow to its new shape. By working the metal with a relatively large number of rollers, greater heat is generated over a given period of time, which results in an annealing effect of the metal workpiece. This tends to soften the workpiece, thereby making it easier to work and also reducing the likelihood of cracks or other damage forming during the spin forming process. The more rapid forming of the workpiece to produce the final product by means of the large number of rollers in simultaneous use, serves to reduce the time required to produce the finished product, thereby resulting in a more economical process. These advantages will be appreciated in the field of automotive exhaust system manufacture, as well as other fields where the rapid spin formation of various seamless articles is required.

It is to be understood that the present invention is not limited to the embodiment described above, but encompasses any and all embodiments within the scope of the following claims.

I claim:

1. A metal spin forming head, comprising:

a roller fixture;

a plurality of first rollers disposed radially inwardly about said roller fixture, defining a first roller set, each of said first rollers having a rim with a width and being evenly spaced apart about said roller fixture in a first coplanar array; and a plurality of second rollers disposed radially inwardly about said roller fixture, defining a second roller set, each of said second rollers having a rim with a width and being evenly spaced apart about said roller fixture in a second coplanar array, one of said second rollers being disposed between each two of said first rollers, wherein the rim width of each of said second rollers is substantially narrower than the rim width of each of said first rollers.

2. The metal spin forming head according to claim 1, further including an independent roller actuating system, whereby each of said rollers is positionally adjusted radially inwardly and outwardly as required independently of other said rollers.

3. The metal spin forming head according to claim 2, wherein said independent roller actuating system comprises a programmable logic control.

4. The metal spin forming head according to claim 1, wherein said second roller set is non-coplanar with said first roller set.

5. The metal spin forming head according to claim 1, further including a hydraulic actuator selectively positionally adjusting each of said rollers.

6. A method of forming a tubular component using the spin forming head according to claim 1, comprising the steps of:

placing a tubular component within the roller fixture and the rollers;

spinning the tubular component relative to the roller fixture;

urging the first rollers radially inward, and decreasing the diameter of the tubular component at the contact circumference of the first rollers with the tubular component;

shifting the tubular component axially relative to the roller fixture, and continuing to decrease the diameter of the tubular component by means of the first rollers;

urging the second rollers radially inward, and decreasing the diameter of the tubular component at the contact circumference of the second rollers with the tubular component; and continuing to selectively shifl the axial position of the tubular component relative to the roller fixture while selectively urging the first rollers and the second rollers inward against the tubular component until a finished shape of the tubular component is achieved.

7. A metal spin forming head system, comprising:

a roller fixture;

a plurality of first rollers disposed radially inward about said roller fixture, defining a first roller set, each of said first rollers having a rim with a width and being evenly spaced apart about said roller fixture in a first coplanar array;

a plurality of second rollers disposed radially inwardly about said roller fixture, defining a second roller set, each of said second rollers having a rim with a width and being evenly spaced apart about said roller fixture in a second coplanar array, one of said second rollers being disposed between each two of said first rollers, wherein the rim width of each of said second rollers is substantially narrower than the rim width of each of said first rollers; and an independent roller actuating system including a programmable logic control, whereby each of said rollers is independently adjusted radially inward and outward.

8. The metal spin forming head system according to claim 7, wherein said second roller set is non-coplanar with said first roller set.

9. The metal spin forming head system according to claim 7, wherein said independent roller actuating system further includes a hydraulic actuator for each of said rollers.

* * * * *